US007249937B2

(12) United States Patent
Inoue et al.

(10) Patent No.: US 7,249,937 B2
(45) Date of Patent: Jul. 31, 2007

(54) HERMETIC ELECTRIC COMPRESSOR AND REFRIGERATION UNIT INCLUDING NON-RESONATING SUPPORT STRUCTURE FOR THE COMPRESSOR

(75) Inventors: Akira Inoue, Fujisawa (JP); Seigo Yanase, Fujisawa (JP); Ikutomo Umeoka, Fujisawa (JP); Atsushi Naruse, Fujisawa (JP)

(73) Assignee: Matsushita Refrigeration Company, Shiga (JP)

( * ) Notice: Subject to any disclaimer, the term of this patent is extended or adjusted under 35 U.S.C. 154(b) by 482 days.

(21) Appl. No.: 10/498,476

(22) PCT Filed: Oct. 30, 2003

(86) PCT No.: PCT/JP03/13892

§ 371 (c)(1),
(2), (4) Date: Jun. 10, 2004

(87) PCT Pub. No.: WO2004/040136

PCT Pub. Date: May 13, 2004

(65) Prior Publication Data

US 2005/0053485 A1 Mar. 10, 2005

(30) Foreign Application Priority Data

Oct. 31, 2002 (JP) ..... 2002-318197

(51) Int. Cl.
*F04B 17/00* (2006.01)

(52) U.S. Cl. ..... 417/363

(58) Field of Classification Search ..... 417/363, 417/310, 902

See application file for complete search history.

(56) References Cited

U.S. PATENT DOCUMENTS

| | | | | |
|---|---|---|---|---|
| 4,118,153 | A | 10/1978 | Stannow et al. | |
| 4,914,921 | A * | 4/1990 | Knodel | 62/59 |
| 5,252,038 | A * | 10/1993 | Mangyo et al. | 417/363 |
| 5,487,648 | A | 1/1996 | Alfano et al. | |
| 5,579,653 | A * | 12/1996 | Sugiyama et al. | 62/508 |
| 5,687,582 | A | 11/1997 | Mangyo et al. | |
| 6,300,378 | B1 | 10/2001 | Tapscott | |
| 6,485,271 | B1 * | 11/2002 | Tack | 417/363 |

(Continued)

FOREIGN PATENT DOCUMENTS

JP 2-161179 6/1990

(Continued)

OTHER PUBLICATIONS

European Search Report corresponding to application No. EP 03 76 9998 dated Aug. 17, 2005.

(Continued)

*Primary Examiner*—Anthony Stashick
*Assistant Examiner*—Vikansha Dwivedi
(74) *Attorney, Agent, or Firm*—RatnerPrestia

(57) ABSTRACT

A hermetic electric compressor including sealed container and coil spring provided for elastically supporting electric compression element housed in sealed container. A consideration has been made to avoid the coincidence in the resonance frequency between coil spring mounted with electric compression element and mechanical vibration caused by electric compression element, or a cavity formed in space. By so doing, creation of a resonation with coil spring is suppressed, and noises and vibrations with the hermetic electric compressors are reduced.

15 Claims, 10 Drawing Sheets

U.S. PATENT DOCUMENTS

| | | | |
|---|---|---|---|
| 2001/0021350 | A1 | 9/2001 | Kim |
| 2002/0009370 | A1 | 1/2002 | Kueon |
| 2002/0051716 | A1 | 5/2002 | Seo |

FOREIGN PATENT DOCUMENTS

| | | |
|---|---|---|
| JP | 5-164047 | 6/1993 |
| JP | 5-79831 | 11/1993 |
| JP | 2002-61575 | 2/2002 |

OTHER PUBLICATIONS

International Search Report corresponding to application No. PCT/JP03/13892 dated Feb. 3, 2004.

* cited by examiner

FIG. 13 PRIOR ART
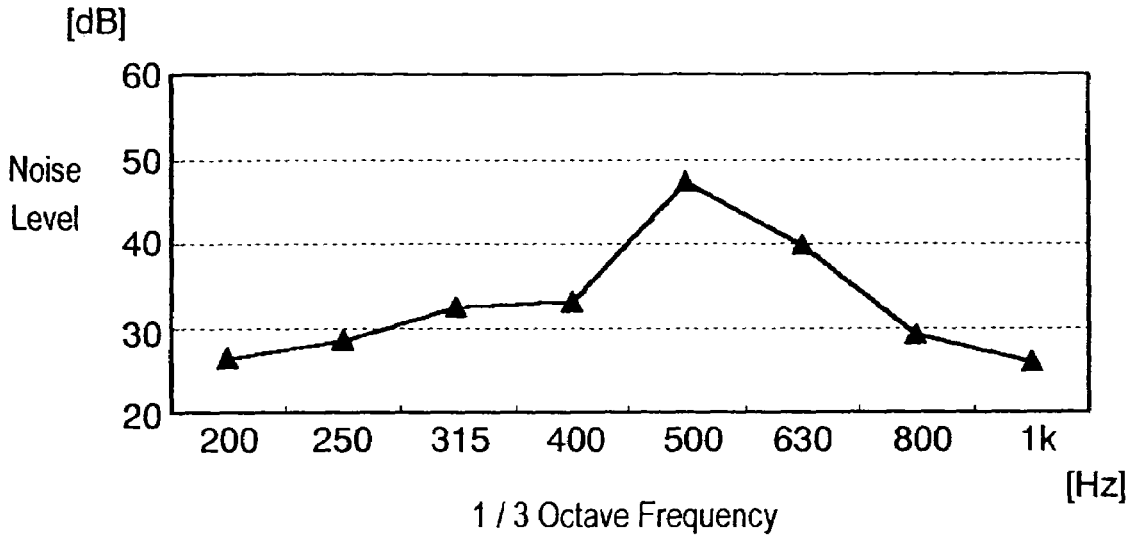
FIG. 14 PRIOR ART
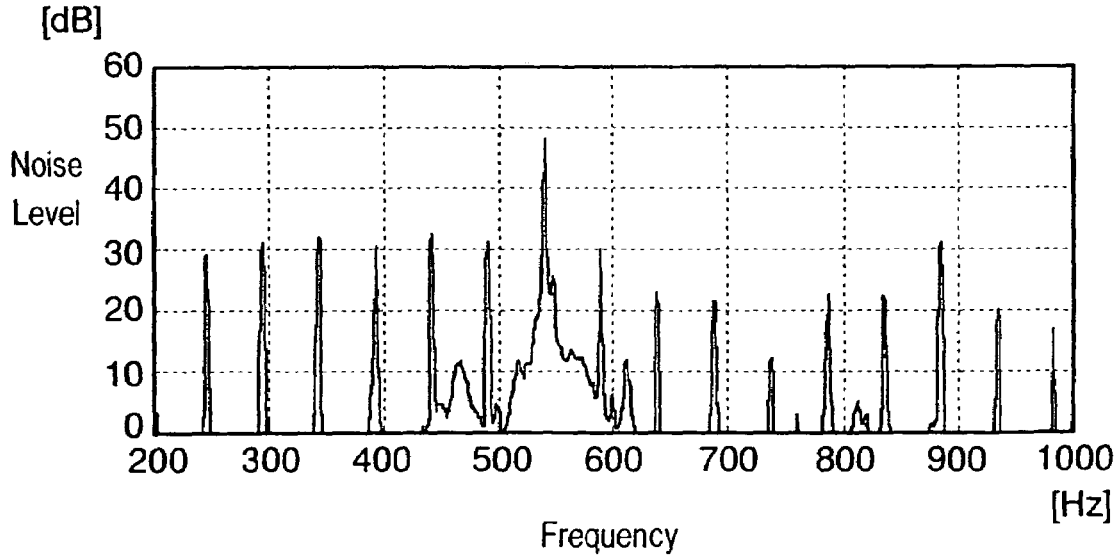

FIG. 15 PRIOR ART
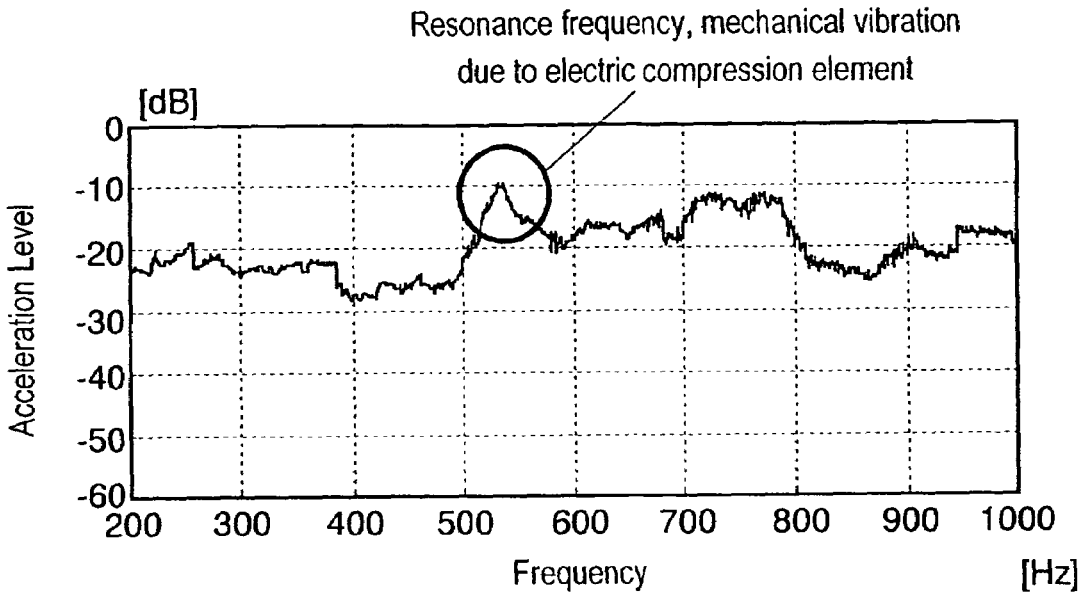
FIG. 16 PRIOR ART
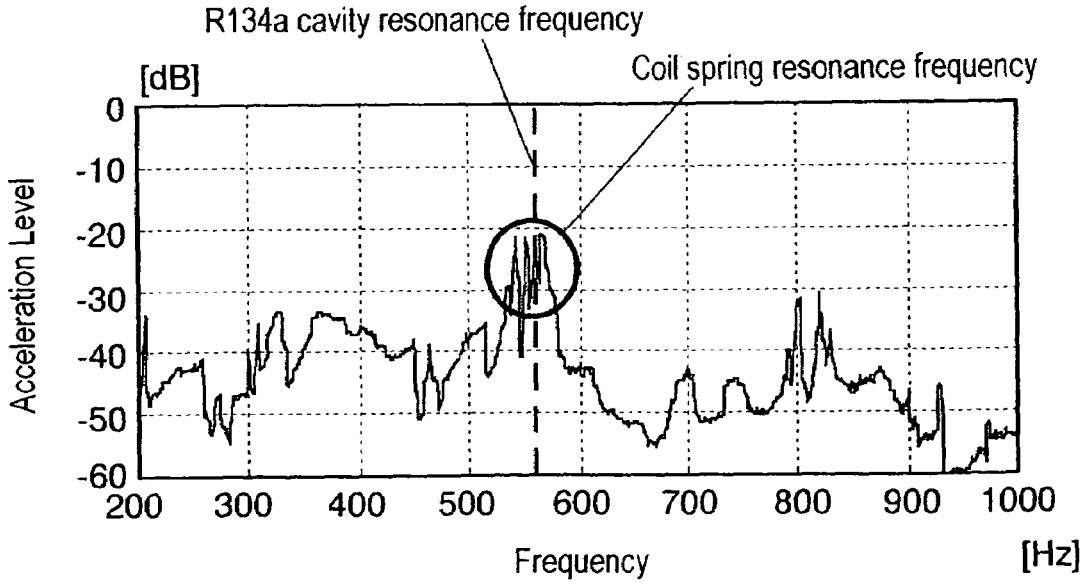

HERMETIC ELECTRIC COMPRESSOR AND REFRIGERATION UNIT INCLUDING NON-RESONATING SUPPORT STRUCTURE FOR THE COMPRESSOR

TECHNICAL FIELD

The present invention relates to a hermetic electric compressor for building a refrigeration unit of refrigerator, automatic vending machine and the like apparatus.

BACKGROUND ART

There have been several models of hermetic electric compressors designed for low-vibration and low-noise application. (As for an example, refer to the patent document 1, Japanese Patent No. 2609713.)

A conventional hermetic electric compressor taught in the above document is described referring to drawings.

FIG. 12 shows the conventional hermetic electric compressor, sectioned vertically, which is referred to in the patent document 1. Referring to FIG. 12, sealed container 1 houses electric compression element 2 and coil spring 3; there is cavity 4 as well in the container. Coil spring 3 is engaged at both ends by snubber 5 protruding from electric compression element 2 side and sealed container 1 side; namely, electric compression element 2 is elastically supported by coil spring 3.

The hermetic electric compressor has been designed to compress the R134a refrigerant, a typical HFC system refrigerant, whose ozone layer destruction factor is zero.

FIG. 13 is noise characteristic chart of the conventional hermetic electric compressor, disclosed in the patent document 1; the lateral axis representing the ⅓ octave frequency, the longitudinal axis the noise level. FIG. 14 details the noise characteristic shown in FIG. 13; where, the lateral axis representing the frequency, the longitudinal axis the noise level.

FIG. 15 shows resonance frequency characteristic of mechanical vibration generated by electric compression element 2 of the conventional hermetic electric compressor; the lateral axis representing the frequency, the longitudinal axis representing level of the acceleration.

The natural resonance frequency due to mechanical vibration generated by electric compression element 2 has been measured by running without load a hermetic electric compressor with the power supply frequency varied, and plotting the acceleration level measured on electric compression element 2, on the frequency axis. The resonance frequency due to mechanical vibration caused by electric compression element 2 is defined as a range of frequencies where the measured acceleration level (vibration level) reach the highest, including the foot areas of the peak in the higher and the lower frequency regions.

FIG. 16 shows resonance frequency characteristic of coil spring 3, in the state where electric compression element 2 is put on coil spring 3; the lateral axis representing the frequency, the longitudinal axis representing the acceleration level. Also shown in the chart is a cavity resonance frequency formed in cavity 4, with R134a used as the refrigerant.

The natural resonance frequency of coil spring 3 has been measured by running without load a hermetic electric compressor with the power supply frequency varied, and plotting the acceleration level measured on the surface of sealed container 1, on the frequency axis. The resonance frequency of coil spring 3 is defined as the range of frequencies where the measured acceleration level (vibration level) reaches the highest, including the foot areas of the peak in the higher and the lower frequency regions.

Now in the following, operation of the above-configured hermetic electric compressor is described.

When power supply is turned ON, electric compression element 2 starts its operation of compressing refrigerant gas. Due to changes of loads and other factors during the compression operation, electric compression element 2 generates mechanical vibrations which contain various frequencies. The mechanical vibration should cause big noises and vibrations if it is conveyed direct to sealed container 1. However, since the elasticity of coil spring 3 absorbs vibration, the vibration which should have been conveyed to sealed container 1 is attenuated. Thus the noises and vibrations are reduced with the hermetic electric compressors.

In the above-described configuration, however, although the mechanical vibrations generated by electric compression element 2 can be absorbed by the elasticity of coil spring 3, the noises and vibrations increase when resonance frequency of the mechanical vibration and that of coil spring 3 coincide, vibration of coil spring 3 is enhanced and resonates at the resonance frequency; the enhanced vibration is propagated to sealed container 1 causing noise and vibration of that frequency. Thus the hermetic electric compressors have had the noise and vibration problem.

Now, a practical example is described. Referring to FIG. 15 and FIG. 16, peak of resonance frequency of the mechanical vibration generated by electric compression element 2 resides at the neighborhood of 540 Hz, which approximately coincides with the peak of resonance frequency of coil spring 3 mounted with electric compression element 2. Since resonance frequency of the mechanical vibration and that of coil spring 3 are in coincidence, the hermetic electric compressor exhibits a noise peak at 540 Hz, as shown in FIG. 14.

On top of the above noise, another noise is generated by the following operation.

Namely, in the conventional hermetic electric compressors, cavity resonance frequency formed in cavity 4 within sealed container 1 resides somewhere at the peak, inclusive of its foot areas, of resonance frequency of coil spring 3 mounted with electric compression element 2.

Referring to FIG. 16, peak of the resonance frequency of coil spring 3 mounted with electric compression element 2 resides at the vicinity of 550 Hz. Also the cavity resonance frequency formed in cavity 4 approximately coincides with the frequency. Furthermore, the hermetic electric compressor has its noise peak in the neighborhood of 550 Hz, as shown in FIG. 14.

The reason for the above is as follows. The mechanical vibration generated by electric compression element 2 vibrates coil spring 3 via upper snubber 5. This creates beating and rubbing between coil spring 3 and the upper and lower snubbers 5. The beating and rubbing is applied on coil spring 3 as vibration energy. Then, coil spring 3 resonates at the inherent resonance frequency of coil spring 3 mounted with electric compression element 2. As the result, noise is generated at the frequency, and the noise vibrates a cavity formed in cavity 4 of sealed container at the resonance frequency. Thus the noise with hermetic electric compressors is enhanced.

Furthermore, if cavity resonance frequency formed in cavity 4 of sealed container 1 coincides with the peak, including the foot areas, of resonance frequency of mechanical vibration generated by electric compression element 2 and resonance frequency of coil spring 3, resonation of coil spring 3 created by the mechanical vibration provides a vibrating effects on cavity 4. Thus the noise due to resonation of the cavity is further increased with the conventional hermetic electric compressors.

DISCLOSURE OF INVENTION

The present invention offers a hermetic electric compressor which includes a sealed container and a coil spring for elastically supporting an electric compression element housed within the sealed container. In which compressor, resonance frequency of the coil spring mounted with the electric compression element does not coincide with resonance frequency of mechanical vibration caused by the electric compression element, or a cavity resonance frequency formed in a space within the sealed container.

BRIEF DESCRIPTION OF THE DRAWINGS

FIG. 13 is a noise characteristic chart of a conventional hermetic electric compressor.

FIG. 14 is a detailed noise characteristic chart of a conventional hermetic electric compressor.

FIG. 15 is a resonance frequency characteristic chart, showing a resonance created by mechanical vibration caused by electric compression element in a conventional hermetic electric compressor.

FIG. 16 is a resonance frequency characteristic chart of a conventional coil spring.

DETAILED DESCRIPTION OF PREFERRED EMBODIMENTS

Exemplary embodiments of the present invention are described in the following, with reference to the drawings. It is not the intention of these embodiments to limit the scope of the present invention. Those constituent portions identical to those of conventional devices are represented by using the same symbols, and detailed description of which portions is eliminated.

First Exemplary Embodiment

Figure 1:
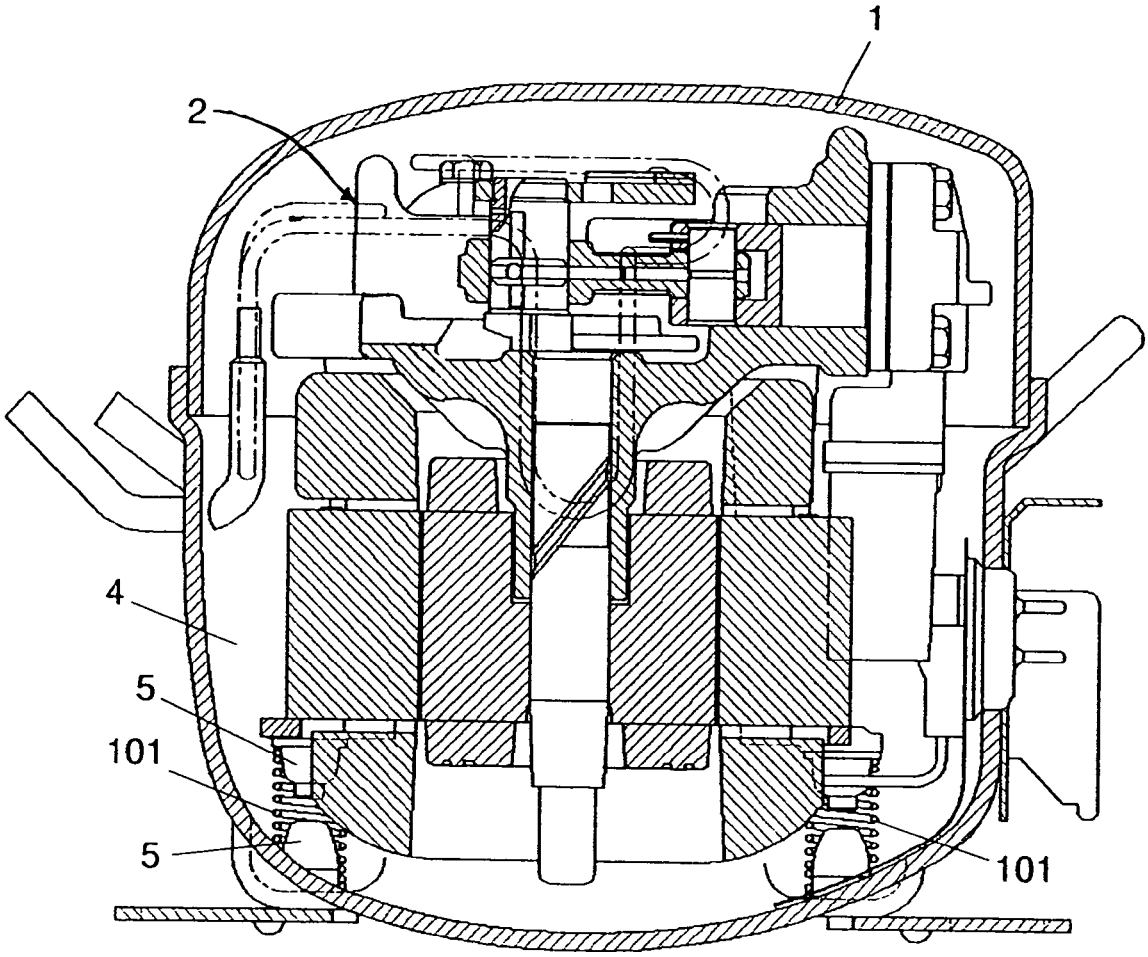
FIG. 1 is a cross sectional view of a hermetic electric compressor in accordance with a first exemplary embodiment of the present invention, sectioned vertically.
Figure 2:
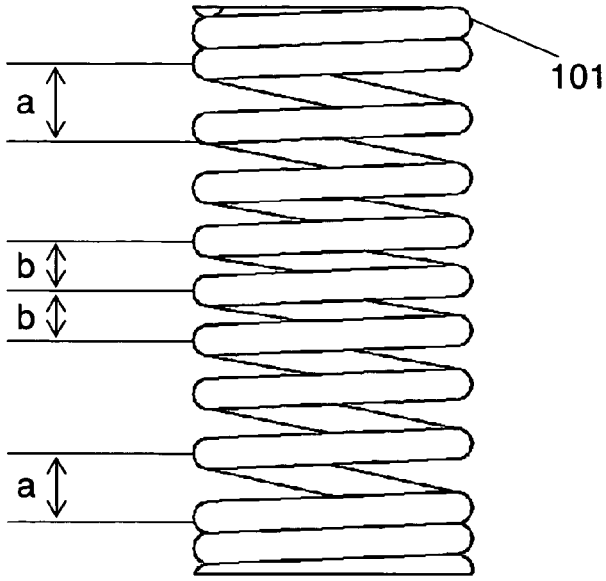
FIG. 2 shows a front elevation of a coil spring in the first embodiment.

FIG. 1 shows a cross sectional view, vertically sectioned, of a hermetic electric compressor in accordance with a first exemplary embodiment. FIG. 2 shows a front elevation of a coil spring in the first embodiment.

Figure 3:
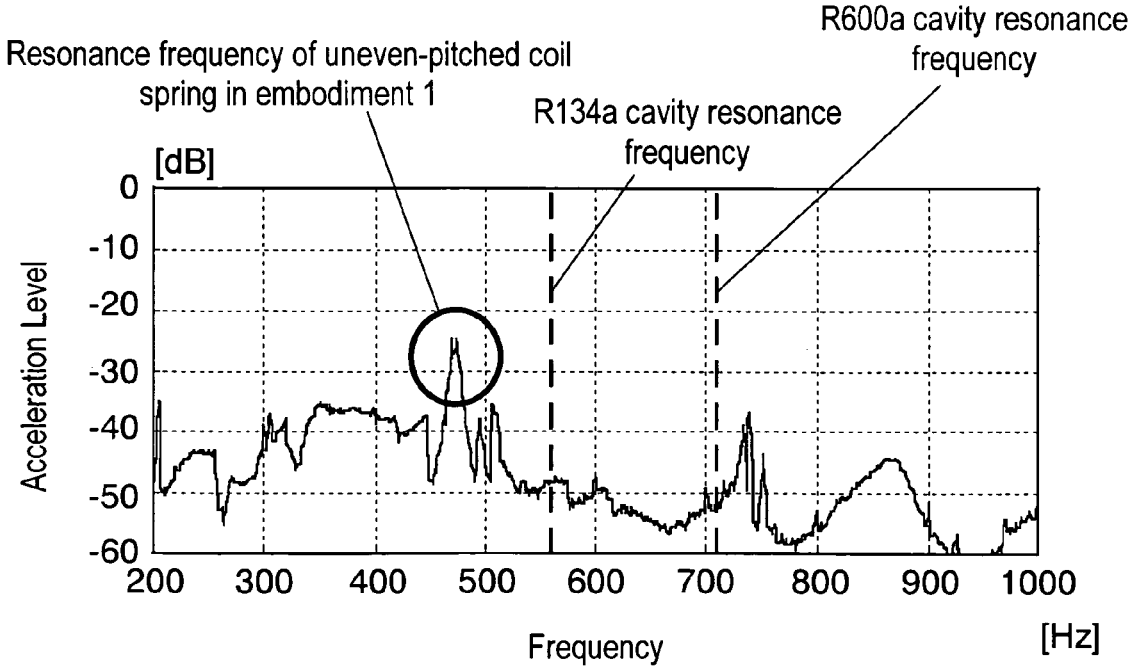
FIG. 3 is a resonance frequency characteristic chart of a coil spring in the first embodiment.

FIG. 3 is a resonance frequency characteristic chart of coil spring 101 mounted with electric compression element 2 in the first embodiment; the lateral axis representing frequency, while the longitudinal axis representing acceleration level. Cavity resonance frequency formed in cavity 4 is also shown, with two examples where R600a and R134a, respectively, are used as the refrigerant.

Figure 4:
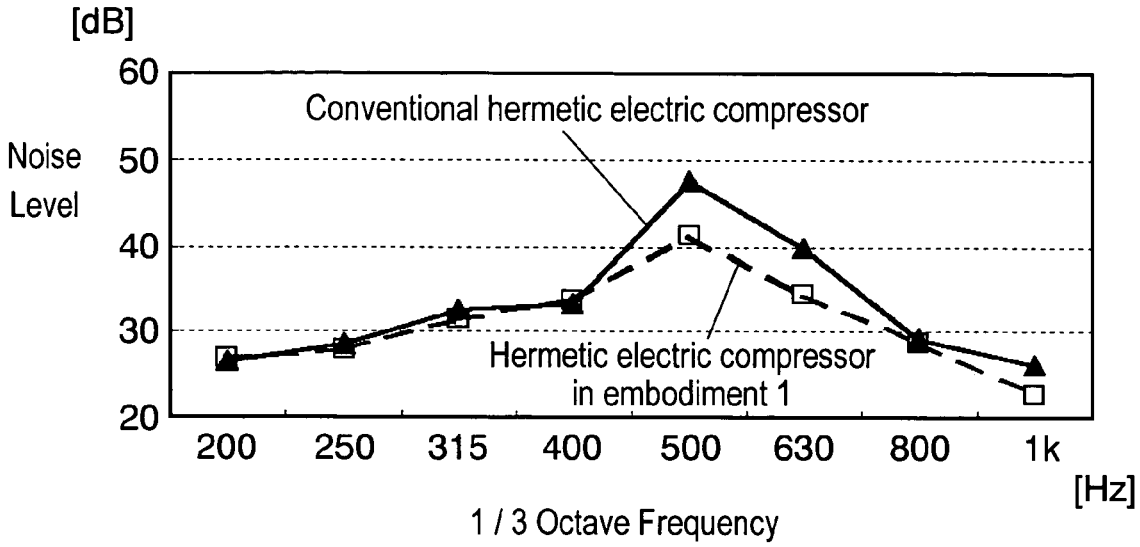
FIG. 4 is a noise characteristic chart, which compares a hermetic electric compressor in the first embodiment and a conventional hermetic electric compressor.
Figure 5:
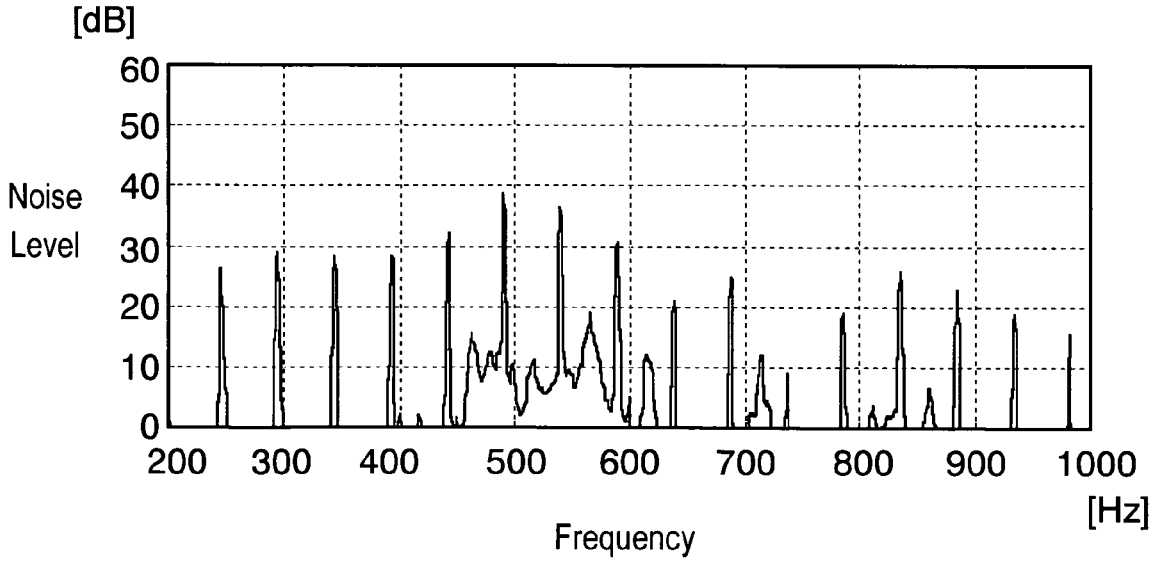
FIG. 5 is a detailed noise characteristic chart of a closed-type electric compressor in the first embodiment.

FIG. 4 compares a hermetic electric compressor in the first embodiment and a conventional hermetic electric compressor in the noise characteristic; the lateral axis representing ⅓ octave frequency, while the longitudinal axis representing noise level. Dotted line indicates a hermetic electric compressor in the first embodiment, solid line indicates a conventional hermetic compressor. FIG. 5 shows details of the noise characteristic in the first embodiment shown in FIG. 4; the lateral axis representing frequency, while the longitudinal axis representing noise level.

Referring to FIG. 1 and FIG. 2, sealed container 1 houses electric compression element 2 and coil spring 101, and is provided with cavity 4 in the inside. At both ends of coil spring 101 are snubbers 5 inserted thereto; each of the snubbers protruding from electric compression element 2 and sealed container 1, respectively. Thus, electric compression element 2 is elastically supported by coil spring 101.

The pitch of coil spring 101 in the first embodiment is uneven, as shown in FIG. 2. It has a wider pitch "a" at the both end portions, and gradually gets narrower to become a narrow pitch "b" at the central portion; namely, it is wound in a coarse pitch at both end portions and the winding gets denser at the central portion, so coil spring 101 is top-bottom symmetry with respect to the center.

Furthermore, a hermetic electric compressor in the first embodiment has been designed for compressing R600a, a representative refrigerant of hydrocarbon system, which is free of chlorine, fluorine, and the global-warming factor is zero.

Now, operation of the above-configured hermetic electric compressor is described below.

When power supply is turned ON, electric compression element 2 starts compressing the refrigerant. As a result of compressing operation, electric compression element 2 causes mechanical vibrations of various frequencies. The level of vibration goes high at the neighborhood of 540 Hz among other frequencies, or the peak resonance frequency with the mechanical vibration.

While the mechanical vibration has its peak in the neighborhood of 540 Hz, the resonance frequency of coil spring 101 mounted with electric compression element 2 resides at the neighborhood of 470 Hz, where acceleration level (vibration level) of the mechanical vibration is low. Thus it is not in coincidence with the resonance frequency of mechanical vibration caused by electric compression element 2. So, coil spring 101 is not driven by the mechanical vibration to create a resonance. Thus, vibration due to resonation of coil spring 101 hardly occurs, and noises and vibrations are reduced with a closed-type electric compressor.

Furthermore, since it uses R600a refrigerant, sonic velocity in the first embodiment is higher as compared with that when R134a refrigerant is used. As the result, a cavity resonance frequency formed in cavity 4 of sealed container 1 shifts high to the neighborhood of 700 Hz, from the neighborhood of 540 Hz. The sonic velocity with a refrigerant gas changes also in accordance with a change in the temperature or the pressure of the refrigerant, as indicated in (formula 1); and the resultant shift in the cavity resonance frequency is normally several tens of Hz. So, even after the shift in resonance frequency is taken place, the peak, inclusive of the foot areas, of coil spring 101's resonance frequency is residing sufficiently away from the cavity resonance frequency, as seen in FIG. 3.

$$f_1 = K\frac{V}{L}(K:\text{constant}) \qquad \text{(formula 1)}$$

A vibration due to resonation of coil spring 101 hardly occurs, and a gaseous column formed in cavity 4 of sealed container is hardly put into resonation. Thus, resonating sound of cavity is reduced. Therefore, the noise can be further lowered with a hermetic electric compressor.

Results of experiments conducted on the above-described uneven-pitched coil spring confirmed that, as seen in FIG. 3, peak level of the resonance frequency of coil spring 101 mounted with electric compression element 2 became low and the resonance frequency shifted to as low as the neighborhood of 470 Hz, while it maintained the elastic modulus at the same level as that of conventional even-pitched coil spring 3.

It has been generally known that the peak level of coil spring 101's inherent resonance frequency goes low when the winding pitch is made to be uneven. In addition to the known phenomenon, it is inferred that in a coil spring wound at an uneven pitch the elastic modulus becomes uneven with respect to an amount of displacement. So, the vibration wave structure of condensation and rarefaction in coil spring 101 is broken, and resonance frequency goes low.

In the present invention, ratio of pitch a to pitch b was decided to be; pitch a:pitch b=(1.09-1.60):1. As the result, peak level of coil spring 101's resonance frequency has been lowered, while the elastic modulus was kept at the comparable level as that of conventional even-pitched coil spring 3. If the value of pitch a against pitch b is in excess of 1.60, the difference of spring constant within coil spring 101 becomes too large, and the amount of displacement grows big in the neighborhood of pitch b, where the spring constant is small. So, there would be a possibility that the spring wires get in direct contact to each other at the neighborhood of pitch b, and coil spring 101 would get broken due to vibration of compressor or other factors. If the value of pitch a against pitch b is smaller than 1.09, uneven-pitched coil spring 101's advantage in the noise reduction is diminished in relation to even-pitched coil spring 3.

Although the ratio is decided to be; pitch a:pitch b=(1.09-1.60):1 in the present invention, more preferably it should be pitch a:pitch b=(1.15-1.40):1. By so doing, the above-mentioned possibility of breakage with a coil spring can be avoided even when there is a 2-3% dimensional dispersion in the manufacturing process. Thus the present invention offers a closed-type electric compressor that provides a greater advantage in the noise reduction.

Relationship among a cavity resonance frequency $f_1$ formed in cavity 4 within sealed container 1, sonic velocity V with refrigerant gas and length L of cavity 4 is represented in (formula 1).

The relationship among resonance frequency $f_2$ of coil spring 101, wire diameter d of coil spring 101, effective number of turns Na and inner diameter D is represented in (formula 2).

$$f_2 = \frac{d}{N_a \times D^2} \qquad \text{(formula 2)}$$

Even when R134a refrigerant is used in the first embodiment, the peak, inclusive of the foot areas, of resonance frequency of coil spring 101 mounted with electric compression element 2 is sufficiently away from the cavity resonance frequency formed in cavity 4 within sealed container 1, as seen in FIG. 3. Therefore, the resonation sound of cavity is suppressed.

There is another approach for avoiding the coincidence of resonance frequencies between coil spring 3 mounted with electric compression element 2 and a cavity formed in cavity 4, whose resonance frequency is determined depending on the size of sealed container 1 as indicated in (formula 1). That is changing the cavity resonance frequency formed in cavity 4. However, modifying the size of a sealed container 1 is not an easy assignment because it leads to not only design modification of a hermetic electric compressor itself but it also makes it unavoidable to extensively re-design refrigeration unit of refrigerators, automatic vending machines, etc.

In the first embodiment of the present invention, however, the coincidence in resonance frequency with a cavity formed in cavity 4 of sealed container 1 can be avoided through a simple modification of coil spring 101 alone. Thus the low noise-level design can be implemented easily.

As the general principle shown in (formula 2), the resonance frequency of coil spring 101 can be lowered by either making wire diameter d smaller, increasing effective number of turns Na or increasing inner diameter D. However, this invites a lowered elastic modulus. Then, coil spring 101 shrinks a great deal due to the weight of electric compression element 2, which leads to an unwanted mechanical contact of electric compression element 2 with sealed container 1 and generation of abnormal sounds. If the wire diameter d is thinned, stress increases to a deteriorated reliability. If the effective number of turns Na is increased, total length of coil spring 101 increases, which leads to an increased overall height of sealed container 1, and a problem of oversized hermetic electric compressor arises.

On the other hand, if coil spring 101's resonance frequency is to be made higher, wire diameter d may be increased, effective number of turns Na may be decreased or inner diameter D may be made to be smaller. However, this invites an increased elastic modulus, so the amount of mechanical vibration generated by electric compression element 2 that can be absorbed by the coil spring decreases, while the amount of vibration conveyed to sealed container 1 increases, which creates a problem of increased noises and vibrations with a hermetic electric compressor.

However, uneven-pitched coil spring 101 used in the first embodiment can lower the resonance frequency without sacrificing the elastic modulus and the reliability. Therefore, the problem of abnormal sounds due to mechanical contact between electric compression element 2 and sealed container 1 caused by a lowered elastic modulus and the problem of a deteriorated reliability due to the increased stress are avoidable. The problem of oversized hermetic electric compressor due to the increased length of coil spring 101 can also be avoided. Furthermore, the problem of increasing noises and vibrations with a hermetic electric compressor due to the increased elastic modulus of coil spring 101 can be avoided either.

Furthermore, since coil spring 101 has been wound to have a top-bottom symmetry in the coiling pitch, the operation of coupling with snubber 5 can be performed regardless of the top-bottom orientation of coil spring 101. This is another advantage in the assembly of hermetic electric compressors.

Second Exemplary Embodiment

Figure 6:
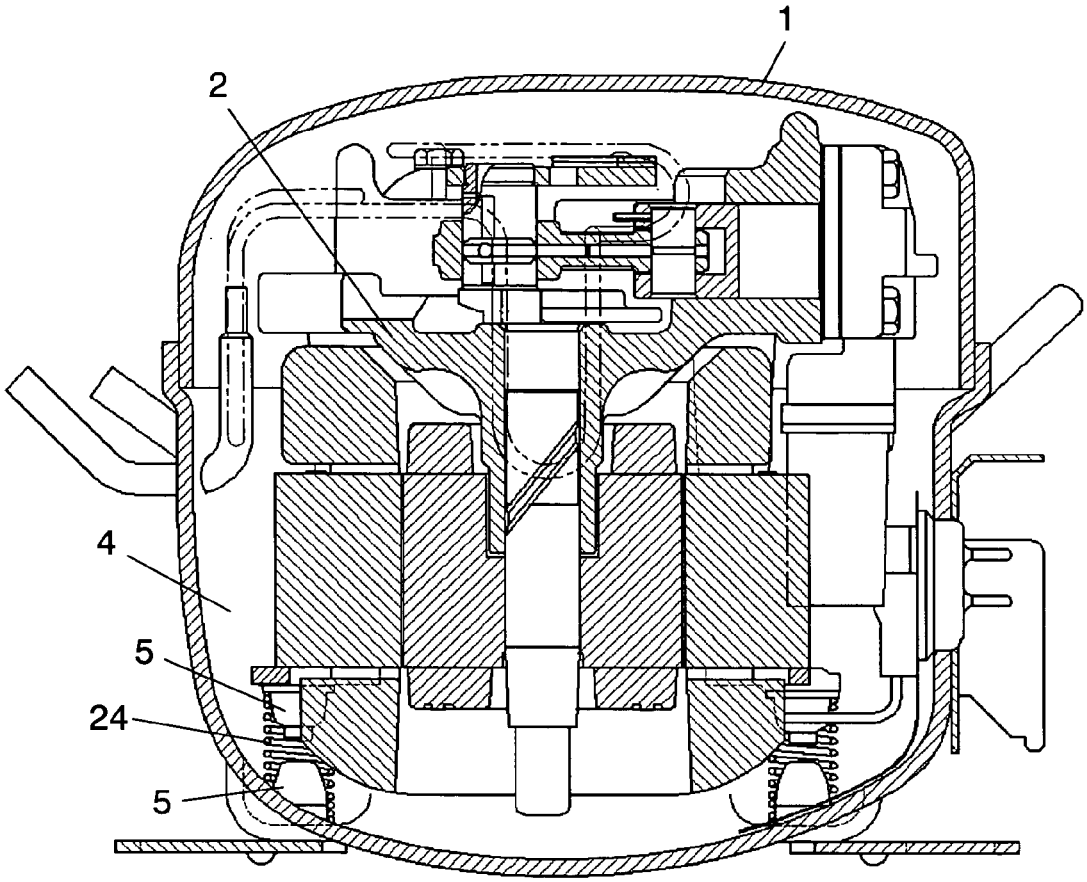
FIG. 6 shows a cross sectional view of a hermetic electric compressor in accordance with a second exemplary embodiment of the present invention.

FIG. 6 shows cross sectional view of a hermetic electric compressor in accordance with a second exemplary embodiment.

Being different from coil spring 101 in the first embodiment, coil spring 24 in the second embodiment has a lowered elastic modulus.

Figure 7:
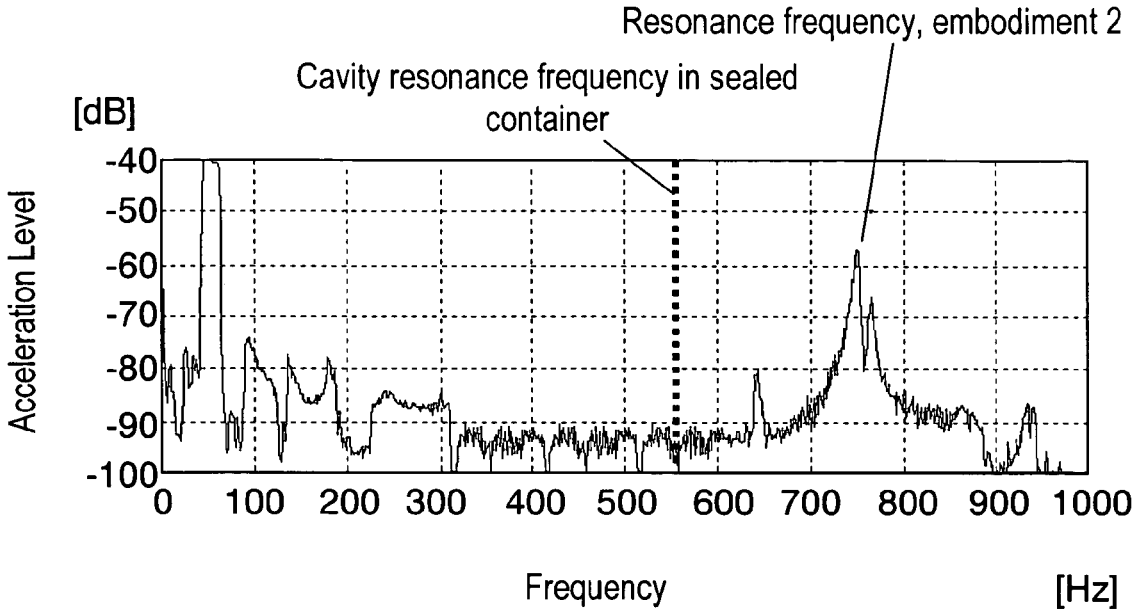
FIG. 7 is a resonance frequency characteristic chart of a coil spring used in a hermetic electric compressor in accordance with the second embodiment.

FIG. 7 is a resonance frequency characteristic chart of coil spring 24 mounted with electric compression element 2 of a hermetic electric compressor in accordance with second embodiment; the lateral axis representing frequency, while the longitudinal axis representing acceleration level. A cavity resonance frequency formed in cavity 4 is also shown in the chart.

Figure 8:
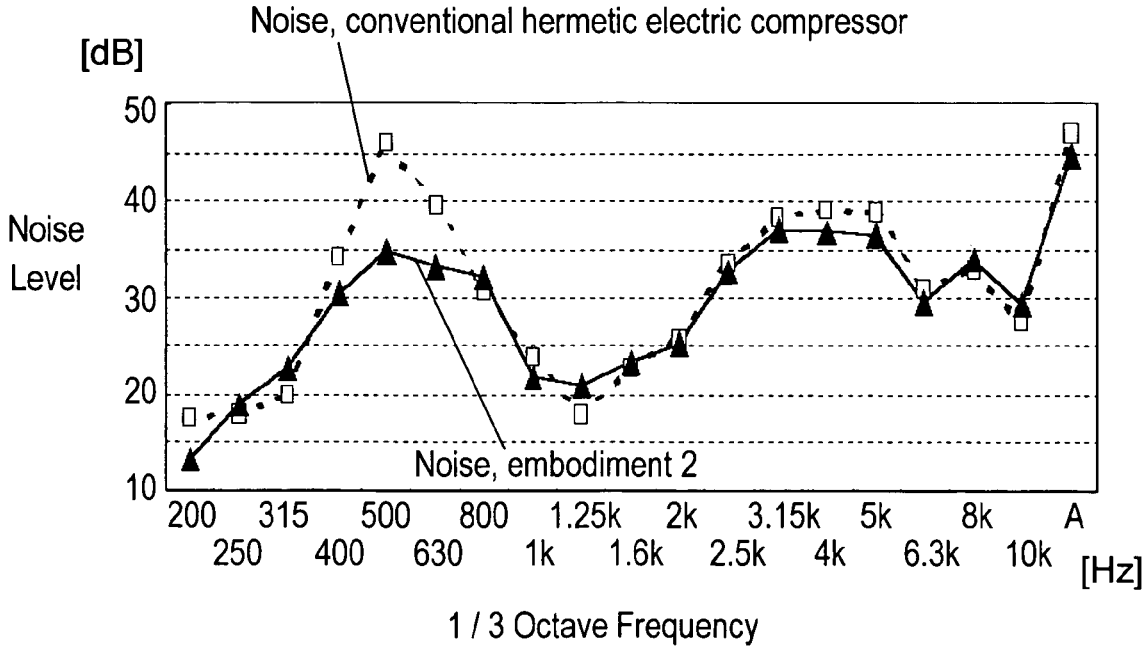
FIG. 8 is a noise characteristic chart of a hermetic electric compressor in the second embodiment.

FIG. 8 shows measured noise level of a hermetic electric compressor in the second embodiment; the lateral axis representing frequency, while the longitudinal axis representing noise level.

Referring to FIG. 6, sealed container 1 houses electric compression element 2 and coil spring 24, and is provided with cavity 4 inside the container. At both ends of coil spring 24 are snubbers 5 inserted thereto; each of the snubbers is protruding from electric compression element 2 and sealed container 1, respectively. Electric compression element 2 is thus supported elastically by coil spring 24.

Defining sonic velocity within cavity 4 in sealed container 1 as V, a cavity resonance frequency formed in cavity 4 is inversely proportional to length L of cavity 4 of sealed container 1, as exhibited in (formula 1).

$$f_1 = K\frac{V}{L}(K:\text{constant}) \qquad \text{(formula 1)}$$

FIG. 7 shows inherent resonance frequency of coil spring 24 mounted with electric compression element 2. The chart has been provided by running without load the hermetic electric compressor varying the operation frequency, and plotting the vibration level measured on the surface of sealed container 1 on the frequency axis.

Resonance frequency of coil spring 24 mounted with electric compression element 2 is defined, based on the results made available by the above measurement, as the range of peak frequency, where the vibration level reaches the highest, including the foot areas at both the higher and the lower frequency regions. The resonance frequency in the present example has the foot area of approximately 50 Hz in both the higher and the lower frequency regions.

Sonic velocity with a refrigerant shifts depending on the changes in temperature and pressure, which shift affects the a cavity resonance frequency formed in cavity 4 of sealed container 1. Resultant change in the resonance frequency is a fluctuation of several tens of Hz.

In the present second embodiment, coil spring 24 having a lowered elastic modulus is employed so that the peak of coil spring 24's resonance frequency is raised to be higher than that of the cavity by approximately 200 Hz. Thereby, it would not coincide with a cavity resonance frequency.

Now in the following, operation of the above-configured hermetic electric compressor is described.

Mechanical vibration caused by electric compression element 2 vibrates coil spring 24 via snubber 5. This creates beating and rubbing with the upper and the lower snubbers 5. The beating and rubbing are applied on coil spring 24 as a vibrating energy. Coil spring 24 resonates at the inherent resonance frequency of coil spring 24 mounted with electric compression element 2. This creates a noise of the above frequency.

The noise is conveyed to cavity 4 of sealed container 1. However, since the peak frequency is higher by 200 Hz than cavity resonance frequency formed in cavity 4, it is totally out of the scope of resonance frequency range including foot area of approximately 50 Hz existing in both the higher and the lower frequency regions, taking the fluctuation of several tens of Hz in the cavity resonance frequency into consideration. Therefore, the noise would not excite the cavity resonance, and travels along cavity 4 within sealed container 1 and reaches sealed container 1 after being attenuated.

Thus, a cavity formed in cavity 4 of sealed container has no source of vibration for resonation, and a hermetic electric compressor of reduced cavity resonance sound is offered.

Furthermore, in the present second embodiment, coil spring 24 of lower elastic modulus is used for making the inherent resonance frequency of coil spring 24 mounted with electric compression element 2 to be different from a cavity's resonance frequency. As the result, coil spring 24 absorbs more amount of mechanical vibration caused by electric compression element 2, as compared with a case where coil spring 24 of higher elastic modulus is used. So, the vibration conveyed to sealed container 1 is significantly attenuated, and vibrations and noises with a hermetic electric compressor are reduced further. Thus, the present invention offers a hermetic electric compressor whose vibration is low and the noise is also low.

There is another approach for avoiding the coincidence of resonance frequencies between coil spring 24 mounted with electric compression element 2 and a cavity formed in cavity 4, whose resonance frequency is determined depending on kind of refrigerant and the size of sealed container 1. That is changing the cavity resonance frequency formed in cavity 4. However, employing a different refrigerant or modifying the size of sealed container 1 is not an easy assignment because it leads to not only design modification of a hermetic electric compressor itself but it also makes it unavoidable to extensively re-design refrigeration unit of refrigerators, automatic vending machines, etc.

In the present second embodiment, however, the coincidence in resonance frequency with a cavity formed in cavity 4 of sealed container 1 can be avoided through a simple modification of coil spring 24 alone. Thus the low noise-level design can be implemented easily.

Furthermore, there are various designing models for a hermetic electric compressor, which employ sealed container 1 of different sizes, different kinds of refrigerant gas, different electric compression elements of different weights, etc. For each of such models, the structure of no-coincidence with a cavity resonance frequency formed in cavity 4 of sealed container 1 can be realized by simply changing coil spring 24 alone. Thus, a low-noise design can be implemented with ease in accordance with the present invention.

Third Exemplary Embodiment

Figure 9:
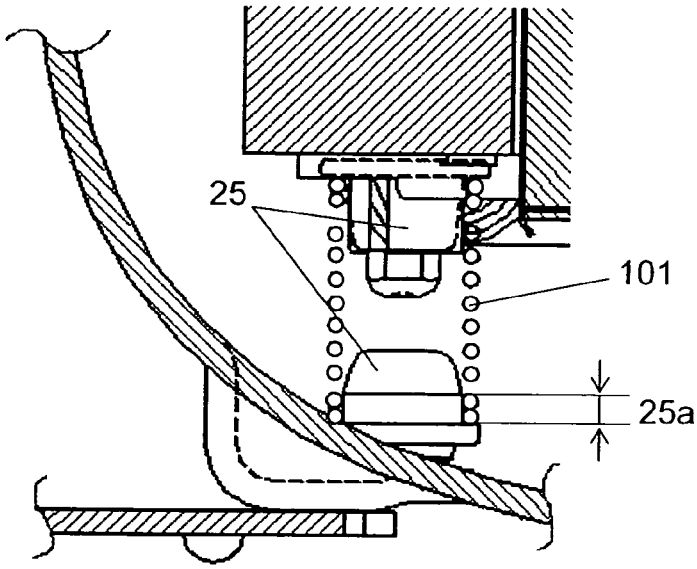
FIG. 9 is a magnified view of a snubber and a coil spring in accordance with a third exemplary embodiment of the present invention.

FIG. 9 is a magnified cross sectional view of snubber 25 and coil spring 101 in a third exemplary embodiment.

Figure 10:
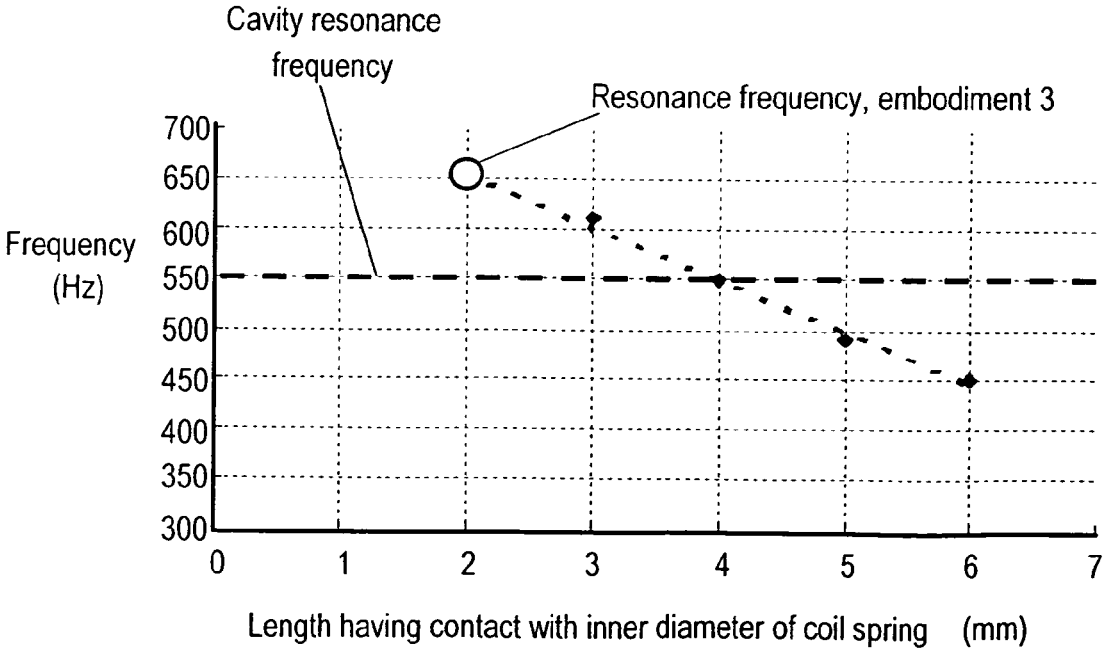
FIG. 10 is a resonance frequency chart, used to show how change in the resonance frequency is caused with a coil spring in the third embodiment.

FIG. 10 is a resonance frequency characteristic chart, which shows results of measurement on relationship between contacting length of snubber 25 with inner diameter of coil spring 101 and the resonance frequency, and a cavity resonance frequency formed in cavity 4 within sealed container 1; the lateral axis representing contacting length of snubber 25 with inner diameter of coil spring 101, the longitudinal axis representing resonance frequency.

Referring to FIG. 9, snubber 25 in the present third embodiment, which is basically the same as that used in a hermetic electric compressor in the first embodiment, has a shorter length in its straight appearance portion 25*a*, so that the length of snubber 25 having contact with inner diameter of coil spring 101 becomes shorter.

In FIG. 10, lengths of snub bar 25 having contact with inner diameter of coil spring 101 have been provided by changing the length of straight appearance portion 25*a* of snubber 25. Resonance frequency was measured for the varied lengths. The shorter the length of straight appearance portion 25*a*, the higher the resonance frequency with coil spring 101. In the present third embodiment, resonance frequency of coil spring 101 has been set to be higher than that of cavity by 100 Hz.

Operation of the above-configured hermetic electric compressor is described below.

The resonance frequency of coil spring 101 mounted with electric compression element 2 has been set at a point which is higher by 100 Hz than that of a cavity formed in cavity 4 of sealed container 1, by reducing the contacting length of straight appearance portion 25*a* with inner diameter of coil spring 101.

Consequently, the sound created by resonance frequency of coil spring 101 mounted with electric compression element 2 does not excite a cavity resonance frequency formed in cavity 4 within sealed container 1, but it travels along cavity 4 of sealed container 1 and reaches sealed container 1 after being attenuated. Thus the noise with hermetic electric compressor has been reduced.

There is another approach for avoiding the coincidence of resonance frequencies between coil spring 101 mounted with electric compression element 2 and a cavity formed in cavity 4, whose resonance frequency is determined depending on kind of refrigerant and the size of sealed container 1. That is changing the cavity resonance frequency formed in cavity 4. However, employing a different refrigerant or modifying the size of sealed container 1 is not an easy assignment because it leads to not only design modification of a hermetic electric compressor itself but it also makes it unavoidable to extensively re-design refrigeration unit of refrigerators, automatic vending machines, etc.

In the present third embodiment, however, the coincidence of coil spring 101's resonance frequency with that of a cavity formed in cavity 4 of sealed container 1 can be avoided through a simple modification of lower snubber 25 in its straight appearance portion 25*a* alone. Thus, the cavity formed in cavity 4 of sealed container 1 has no source of vibration for resonation, and a hermetic electric compressor of low cavity resonance sound is offered.

Furthermore, there are various designing models for a hermetic electric compressor, which employ sealed container 1 of different sizes, different kinds of refrigerant gas, different electric compression elements of different weights, etc. For each of such models, the structure of no-coincidence with cavity resonance frequency formed in cavity 4 of sealed container 1 can be realized by simply changing coil spring 101 alone. Thus, a low-noise design can be implemented with ease in accordance with the present invention.

Fourth Exemplary Embodiment

Figure 11:
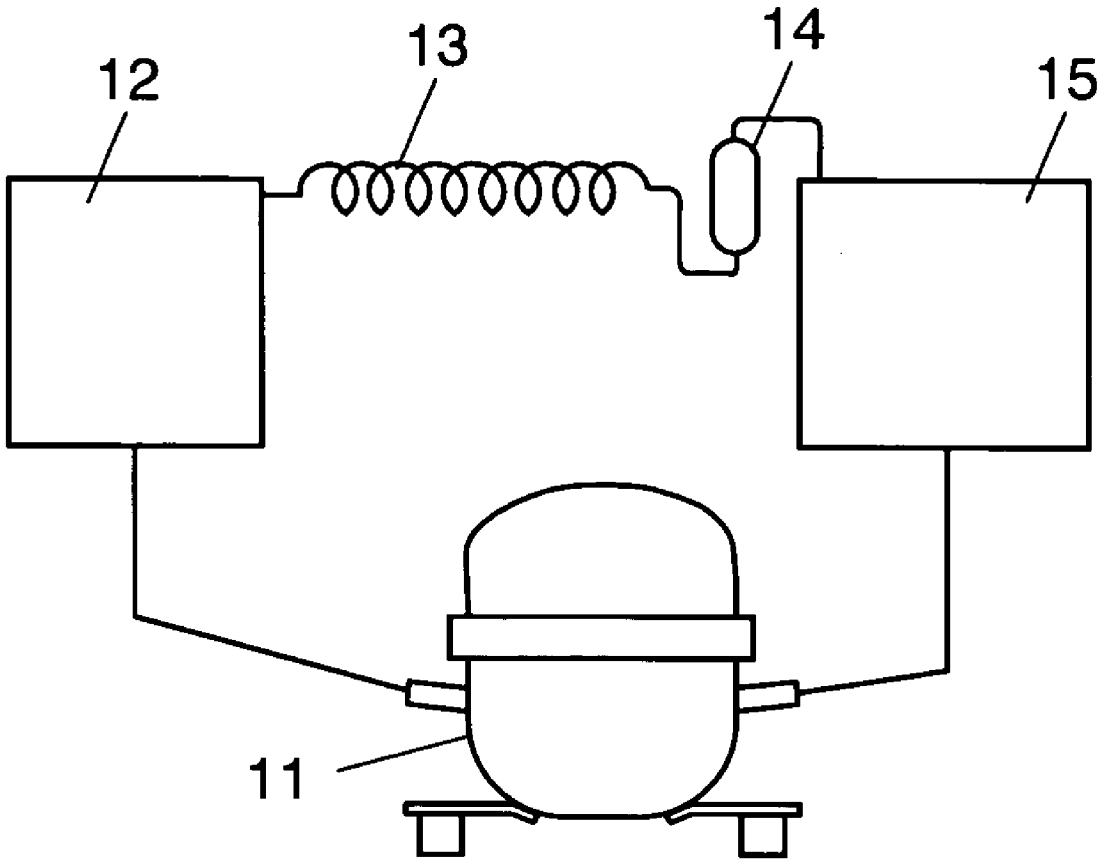
FIG. 11 shows how a refrigeration unit in accordance with a fourth exemplary embodiment of the present invention is structured.
Figure 12:
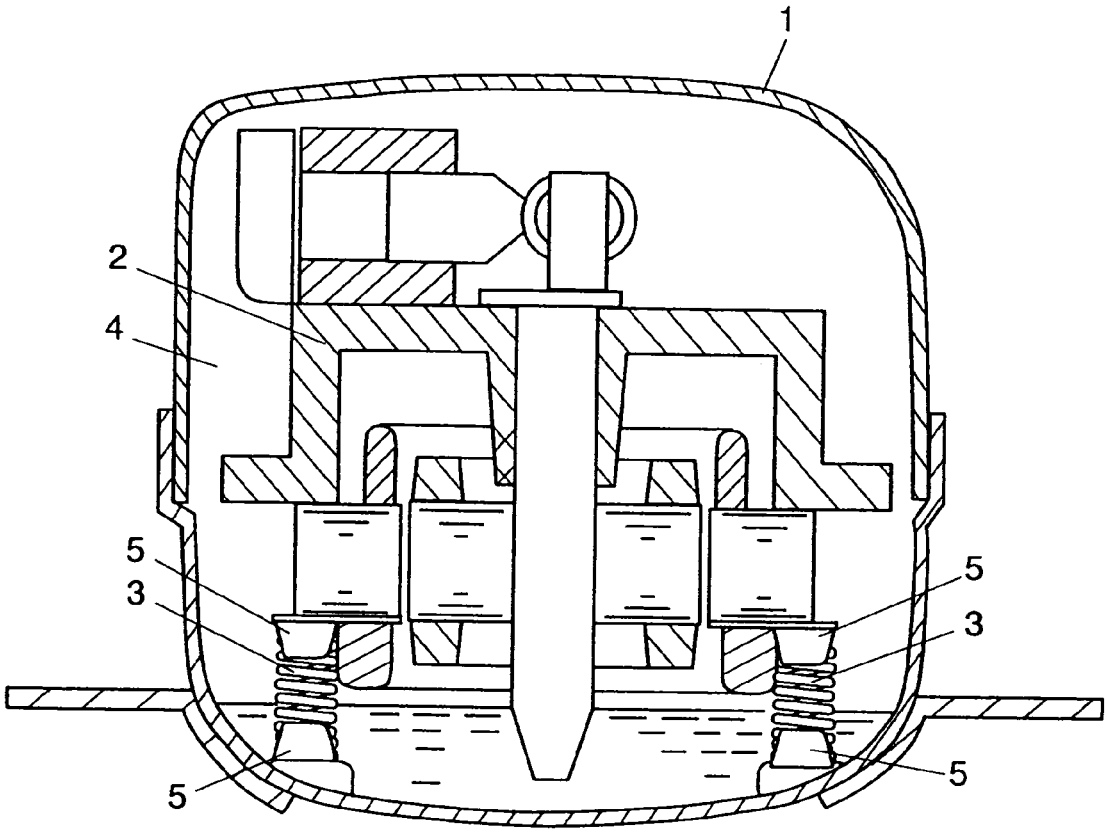
FIG. 12 PRIOR ART
FIG. 12 shows a cross sectional view of a conventional hermetic electric compressor, sectioned vertically.

FIG. 11 shows a structure of a refrigeration unit in accordance with a fourth exemplary embodiment.

Referring to FIG. 11, compressor 11, condenser 12, expansion device 13, drier 14 and evaporator 15 are coupled by means of piping for allowing a fluid to circulate.

Operation of the above-configured refrigeration unit is described below.

As to the noises originating from compressor 11, in addition to those radiated to outside direct from compressor 11, some are propagated through the inside of the piping to other elements constituting the refrigeration unit, which have been coupled together by the piping. These noises are conveyed to evaporator 15 side, in which the pressure pulsating of refrigerant gas is small, and reverberate in the spacious inside of evaporator 15. The sound at evaporator is discharged direct toward outside. However, since compressor 11 has a low cavity resonating sound, the noises originating from compressor 11 and propagating to evaporator 15 via the inside of piping are small. Thus, a low-noise refrigeration unit is offered.

A hermetic electric compressor in the present invention reduces the creation of a resonation by coincidence of coil spring resonance frequency and resonance frequency of mechanical vibration. Thus, a low-noise and low-vibration configuration is implemented for the hermetic electric compressors.

A hermetic electric compressor in the present invention reduces the creation of a resonation by coincidence of coil spring resonance frequency and cavity resonance frequency formed in the space. Thus, a low-nose and low-vibration configuration is implemented for the hermetic electric compressors.

INDUSTRIAL APPLICABILITY

Creation of a resonation with a coil spring due to mechanical vibration caused by an electric compression element can be avoided in a hermetic electric compressor in accordance with the present invention, and the resultant noises and vibrations are reduced. Therefore, the compressor can be used also in a refrigeration showcase, a dehumidifying apparatus, etc.

The invention claimed is:

1. A hermetic electric compressor comprising a sealed container, and a plurality of coil spring for elastically supporting an electric compression element housed within the sealed container from bottom of the sealed container; wherein the coil spring mounted with the electric compression element has an uneven pitch so that self-resonance frequency of the coil spring does not coincide with resonance frequency of mechanical vibration caused by operation of the electric compression element.

2. The hermetic electric compressor of claim 1, wherein resonance frequency of the coil spring does not coincide with a cavity resonance frequency formed in a cavity within the sealed container.

3. The hermetic electric compressor of claim 2, wherein the peak of resonance frequency of the coil spring and the cavity resonance frequency are separated from each other for at least 100 Hz.

4. The hermetic electric compressor of claim 2, wherein resonance frequency of the coil spring is higher than the cavity resonance frequency.

5. The hermetic electric compressor of claim 1, wherein the coil spring has a top-bottom symmetry with respect to the center.

6. The hermetic electric compressor of claim 1, further comprising a hydrocarbon refrigerant which is free of chlorine, fluorine.

7. The hermetic electric compressor of claim 1, wherein among the designing models each of which having different cavity resonance frequency or electric compression element of different weight, the coincidence in resonance frequency between the coil spring and the cavity, or the mechanical vibration, can be avoided by replacing the coil spring with other one.

8. The hermetic electric compressor of claim 1, further provided with a snubber protruding from the electric compression element side and a snubber protruding from the sealed container side, which snubber is to be inserted to the coil spring at both ends; wherein among the designing models each of which having different cavity resonance frequency or electric compression element of different weight, the coincidence in resonance frequency between the coil spring and the cavity can be avoided by changing length of a portion of the snubber, which portion making contact with inner diameter of the coil spring.

9. A refrigeration unit comprising a compressor, a condenser, a drier, an expansion device and an evaporator; wherein the compressor is a hermetic electric compressor comprising:

a sealed container, and a plurality of coil spring for elastically supporting an electric compression element housed within the sealed container from bottom of the sealed container; wherein the coil spring mounted with the electric compression element has an uneven pitch so that self-resonance frequency of the coil spring mounted with the electric compression element does not coincide with resonance frequency of mechanical vibration caused by operation of the electric compression element.

10. The hermetic electric compressor of claim 1, wherein the peak of resonance frequency of the coil spring and the cavity resonance frequency are separated from each other for at least 100 Hz.

11. The hermetic electric compressor of claim 1, wherein resonance frequency of the coil spring is higher than the cavity resonance frequency.

12. The hermetic electric compressor of claim 1, further comprising a hydrocarbon refrigerant which is free of chlorine, fluorine.

13. The hermetic electric compressor of claim 1, wherein among the designing models each of which having different cavity resonance frequency or electric compression element of different weight, the coincidence in resonance frequency between the coil spring and the cavity, or the mechanical vibration, can be avoided by replacing the coil spring with other one.

14. The hermetic electric compressor of claim 1, further provided with a snubber protruding from the electric compression element side and a snubber protruding from the sealed container side, which snubber is to be inserted to the coil spring at both ends; wherein among the designing models each of which having different cavity resonance frequency or electric compression element of different weight, the coincidence in resonance frequency between the coil spring and the cavity can be avoided by changing length of a portion of the snubber, which portion making contact with inner diameter of the coil spring.

15. A refrigeration unit comprising a compressor, a condenser, a drier, an expansion device and an evaporator; wherein the compressor is a hermetic electric compressor comprising:

a sealed container, and a plurality of coil spring for elastically supporting an electric compression element housed within the sealed container from bottom of the sealed container; wherein the coil spring mounted with the electric compression element has an uneven pitch so that self-resonance frequency of the coil spring mounted with the electric compression element does not coincide with a cavity resonance frequency formed in a cavity within the sealed container by operation of the electric compression element.

* * * * *